US005608913A

United States Patent [19]

Lacoste

[11] Patent Number: 5,608,913

[45] Date of Patent: Mar. 11, 1997

[54] UPPER BODY GARMENTS HAVING ELASTIC GUSSETS

[75] Inventor: René Lacoste, Saint-Jean-De-Luz, France

[73] Assignee: La Chemise Lacoste, France

[21] Appl. No.: 407,013

[22] PCT Filed: Jul. 28, 1994

[86] PCT No.: PCT/FR94/00954

§ 371 Date: May 15, 1995

§ 102(e) Date: May 15, 1995

[87] PCT Pub. No.: WO95/03717

PCT Pub. Date: Feb. 9, 1995

[30] Foreign Application Priority Data

Jul. 29, 1993 [FR] France ..... 93 09350

[51] Int. Cl.[6] ..... A41B 1/00

[52] U.S. Cl. ..... 2/115; 2/78.3; 2/108; 2/125

[58] Field of Search ..... 2/69, 74, 75, 78.3, 2/79, 80, 90, 105, 106, 108, 115, 125, 211, 221, 401, 227, 228, 243.1, DIG. 4

[56] References Cited

U.S. PATENT DOCUMENTS

| | | | |
|---|---|---|---|
| 243,498 | 6/1881 | Brown | 2/125 |
| 1,973,419 | 9/1934 | Trageser | 2/125 |
| 2,554,380 | 5/1951 | Olrich et al. | 2/90 |
| 2,941,210 | 6/1960 | Bren | 2/125 |
| 3,037,210 | 6/1962 | Neuman | 2/125 |

FOREIGN PATENT DOCUMENTS

| | | | |
|---|---|---|---|
| 837909 | 2/1939 | France | 2/227 |
| 1400246 | 4/1965 | France | 2/69 |
| 2261716 | 9/1975 | France | 2/227 |
| 2449415 | 9/1980 | France | 2/115 |
| WO9503717 | 2/1995 | WIPO | 2/115 |

*Primary Examiner*—C. D. Crowder
*Assistant Examiner*—Gloria Hale
*Attorney, Agent, or Firm*—Eckert Seamans Cherin & Mellott

[57] ABSTRACT

Shirts or jackets particularly for sportswear in which triangular stretch gussets are incorporated in the garments, under the sleeves and on either side of the body, in order to increase the freedom of movement of the arms.

6 Claims, 1 Drawing Sheet

UPPER BODY GARMENTS HAVING ELASTIC GUSSETS

The present invention relates to upper body garments such as shirts, jackets, and any garments for which it is desirable to leave great freedom of movement to the arm.

BACKGROUND OF THE INVENTION

For golf, and above all for tennis, this freedom has been sought by using shirts and jackets in which all of the dimensions have been increased.

But such an increase in size is unattractive in appearance and it still does not provide full freedom to the arms when they are stretched in a golf swing or while serving in tennis when one arm is moved to throw the ball and then the other to hit it.

As a result, before serving, tennis players instinctively raise the armholes of their garments to loosen their sleeves.

However that precaution does not prevent the bottom portions of the sleeves being retained by the body where the sleeve is attached at the armhole.

OBJECT AND SUMMARY OF THE INVENTION

The object of the invention is mainly to reduce such retention.

According to the invention, sportswear garments, in particular shirts and jackets, include stretch gussets placed on either side of the body and on the undersides of the sleeves, wherein said gussets are triangular and symmetrical, and wherein their axes of symmetry coincide with the locations of traditional seams, their sides being sewn to the remainder of the garment, and their bases coinciding with each other and with the bottom portions of the armholes.

The gussets are sewn together via said bases or else they are made from a single piece of fabric that is approximately lozenge-shaped.

BRIEF DESCRIPTION OF THE DRAWING

Other characteristics and advantages of the invention appear from the following description of particular embodiments given purely by way of non-limiting example and with reference to the figures in which.

MORE DETAILED DESCRIPTION

Figure 1:
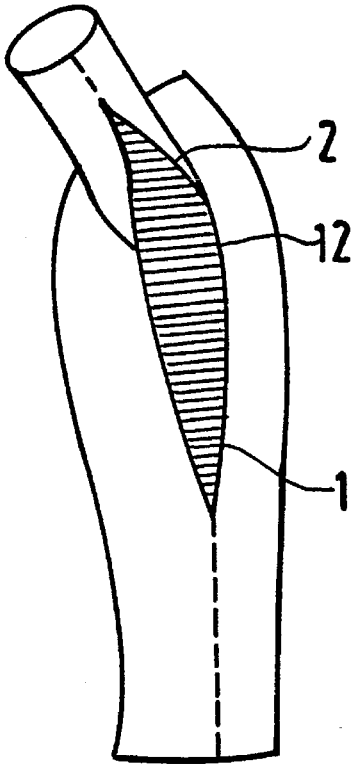
FIG. 1 shows a garment of the invention with an arm raised, the gussets being made of 2 and 2 rib fabric and comprising a single piece.

In FIG. 1, there can be seen a stretch piece 12 constituted by a single piece of fabric having two tips in the form of isosceles triangles 1 and 2 whose edges are sewn respectively along the side of the body and along the underside of the sleeve. By way of example, this piece of fabric is made of 2 and 2 rib fabric using Nm 75/1 yarn instead of the single piqué fabric generally used for golf and tennis shirts.

To achieve the object of the invention using gussets of 2 and 2 rib fabric, the ribs must be perpendicular to the axes (not shown) of the gussets.

To show the characteristics of the stretch gussets compared with single piqué with small ribs, four gussets having the dimensions 50 cm long by 20 cm wide have been tested as follows:

piece "A" in 2 and 2 rib fabric in the rib direction;

piece "B" in 2 and 2 rib fabric in the direction perpendicular to the ribs;

piece "C" in single piqué fabric in the rib direction; and piece "D" in single piqué fabric in the direction perpendicular to the ribs.

One end of each piece was fixed while its other end was loaded with 200 grams, giving an elongation:

of 2 cm for piece "A"; and of 13 cm for piece "B";

of 2 cm for piece "C"; and of only 3 cm for piece "D".

Figure 2:
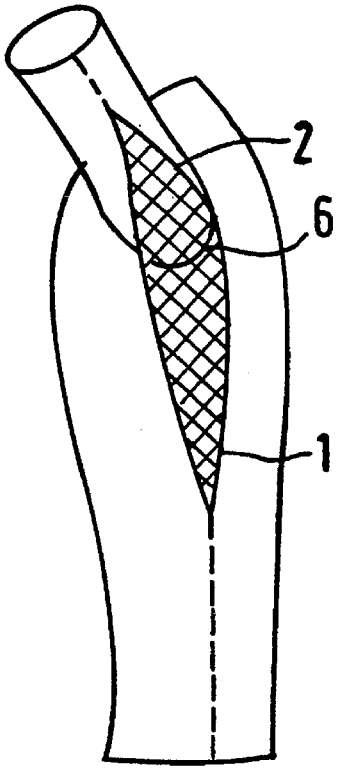
FIG. 2 shows two gussets of stretch netting under the same conditions.

In FIG. 2, there can be seen two gussets 1 and 2 made of open stretch net capable of stretching at least in the axial direction of the gussets (not shown).

Using the net fabric, sweat from the armpits is mostly eliminated through the fabric. The gussets 1 and 2 are united via their bases at the armpit 6 or in the bottom portion of the armhole.

For example, when using a large ratio of LYCRA spandex yarn it is easy to obtain the same elasticity as with a 2 and 2 rib fabric in the axial direction of the gussets, and it is also easy to obtain the same elasticity in the direction perpendicular to the axes of the gussets, thereby improving the freedom of horizontal movement for the arms, e.g. during forehand and backhand strokes while playing tennis.

Naturally, numerous variants may be applied, in particular by substituting equivalent technical means, without thereby going beyond the scope of the invention.

I claim:

1. A garment for covering the upper torso having a body portion with two sides and traditionally sewn together to form an armhole on each side;

a pair of sleeves; and, stretch gussets;

wherein the sleeves are traditionally sewn to the sides of the body portion at the armholes;

wherein the sleeves traditionally have a seam running along an underside of each sleeve;

wherein the body portion traditionally has a seam running along each of its sides;

wherein each stretch gusset has a symmetrical opposite-isosceles-triangle-like shape with two equal sides; a base, in which the base is shorter in length than the equal sides; and an axis of symmetry passing through a center of the base and through a vertex of the equal sides;

wherein one stretch gusset is sewn into the underside of each one of the sleeves such that the axis of symmetry of the stretch gusset is parallel to the seam traditionally running along the underside of the sleeve to which the stretch gusset is sewn;

wherein one stretch gusset is sewn into each side of the body portion such that the axis of symmetry of the stretch gusset is parallel to the seam traditionally running along the side of the body portion to which the stretch gusset is sewn; and, wherein the base of each stretch gusset sewn into the side of the body portion is sewn to the base of the gusset sewn into the underside of the sleeve attached to the same side of the body portion such that the gusset bases come together at the armhole.

2. The garment according to claim 1, wherein the two gussets sewn into (1) the side of the body portion and (2) the sleeve which is sewn into the same side of the body portion are replaced by an approximately lozenge-shaped gusset having two axes of symmetry with the longer axis oriented in the garment to be parallel with the traditional seams in the underside of the sleeve and on the side of the body portion.

3. The garment according to claim 1 wherein the gussets are made of net fabric.

4. The garment according to claim 1 wherein the gussets are made of a ribbed fabric having ribs and are cut in such a manner that the axes of symmetry of the gussets are perpendicular to the ribs, and wherein the elasticity of the ribbed fabric in a direction perpendicular to the ribs is at least five (5) times greater than the elasticity of the ribbed fabric in a direction parallel to the ribs.

5. The garment according to claim 1 wherein the gussets are made of a ribbed fabric having ribs and are cut in such a manner that the axes of symmetry of the gussets are perpendicular to the ribs, and wherein the elasticity of the ribbed fabric in a direction perpendicular to the ribs exceeding the elasticity of the fabric of the body portion and sleeves in a ratio of not less than 10 to 3.

6. The garment of claim 1 wherein the garment is selected from the group consisting of shirts and jackets.

* * * * *